US006796141B2

(12) United States Patent
Kästingschäfer et al.

(10) Patent No.: US 6,796,141 B2
(45) Date of Patent: Sep. 28, 2004

(54) COOLER AND A METHOD FOR COOLING HOT BULK MATERIAL

(75) Inventors: Gerhard Kästingschäfer, Wadersloh (DE); Wolfgang Rother, Oelde (DE); Günter Milewski, Ennigerloh (DE); Martin Uhde, Ennigerloh (DE); Arthur Berger, Ennigerloh (DE); Hermann Niemerg, Ennigerloh (DE); Ludwig Könning, Ahlen (DE); Helmut Berief, Beckum (DE); Patrick Jean-Marc Brunelot, Marseilles (FR)

(73) Assignee: Polysius AG, Beckum (DE)

( * ) Notice: Subject to any disclaimer, the term of this patent is extended or adjusted under 35 U.S.C. 154(b) by 31 days.

(21) Appl. No.: 10/257,431

(22) PCT Filed: Apr. 11, 2001

(86) PCT No.: PCT/EP01/04198

§ 371 (c)(1),
(2), (4) Date: Dec. 4, 2002

(87) PCT Pub. No.: WO01/77600

PCT Pub. Date: Oct. 18, 2001

(65) Prior Publication Data

US 2003/0126878 A1 Jul. 10, 2003

(51) Int. Cl.[7] ..... F25D 25/00; F25D 13/06

(52) U.S. Cl. ..... 62/378; 62/63

(58) Field of Search ..... 62/62, 63, 304, 62/378, 381

(56) References Cited

U.S. PATENT DOCUMENTS

| | | | | |
|---|---|---|---|---|
| 3,010,218 A | * | 11/1961 | Sylvest | 34/164 |
| 5,704,779 A | * | 1/1998 | Enkegaard | 432/78 |
| 5,890,888 A | * | 4/1999 | Enkegaard | 432/77 |

FOREIGN PATENT DOCUMENTS

| | | | |
|---|---|---|---|
| DE | 9403614 U1 | * | 7/1995 |
| DE | 4417422 A | * | 11/1995 |
| WO | WO9848231 A | * | 10/1998 |

* cited by examiner

*Primary Examiner*—Denise L. Esquivel
*Assistant Examiner*—Malik N. Drake
(74) *Attorney, Agent, or Firm*—Muramatsu & Associates

(57) ABSTRACT

The invention relates to a cooler and to a method for cooling hot bulk material. The hot bulk material is fed on a stationary aerating base through which cooling gas can flow and is transported by means of reciprocating conveyor elements disposed above the aerating base. In the cooler and cooling method, at least two groups of conveyor elements are used which are actuated jointly in the transport direction and separately from one another against the transport direction.

10 Claims, 7 Drawing Sheets

COOLER AND A METHOD FOR COOLING HOT BULK MATERIAL

Figure 1:
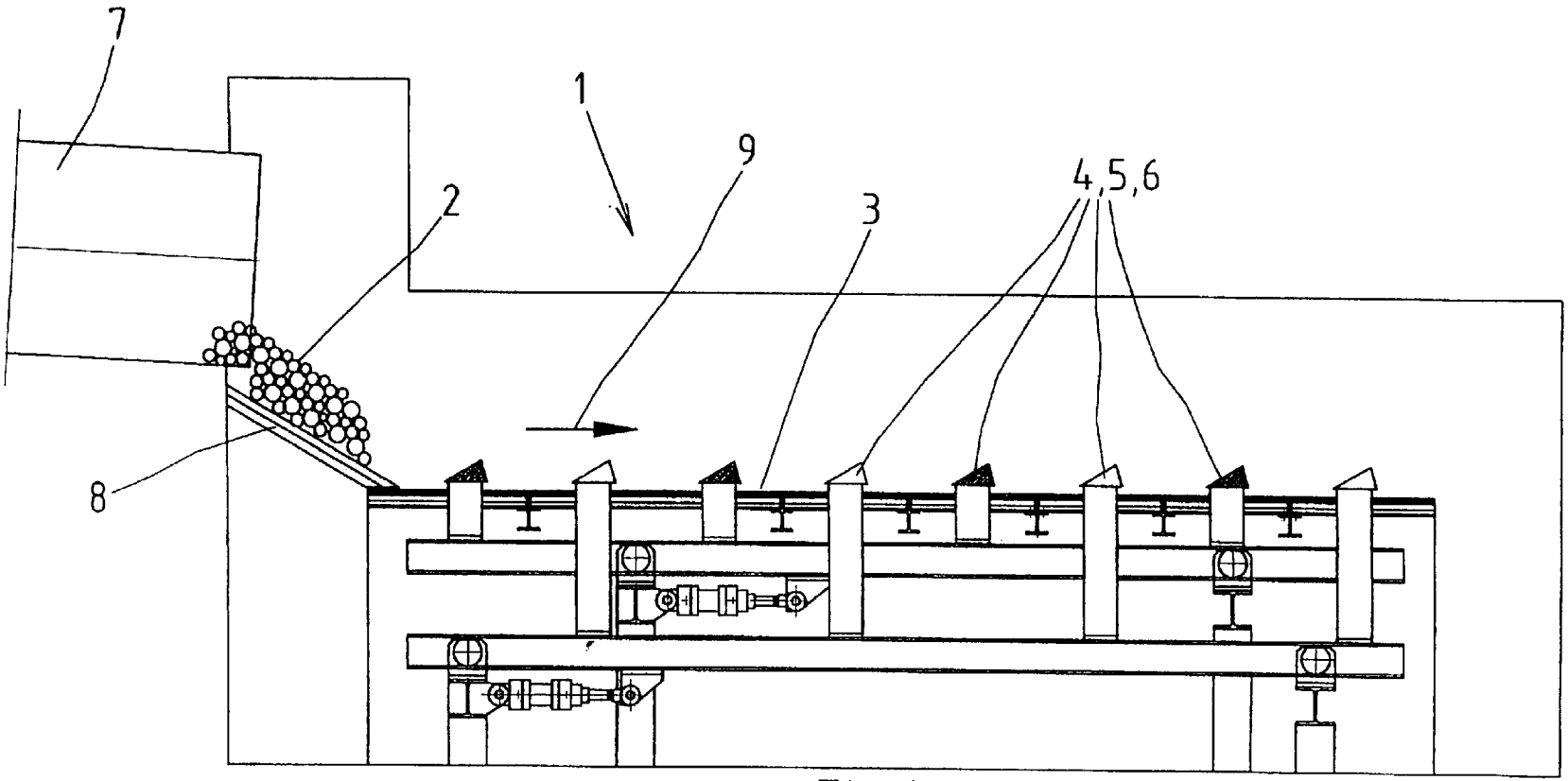

The invention relates to a cooler for cooling hot bulk material according to the preamble to claim 1 and also to a method of cooling hot bulk material according to the generic concept of claim 9.

For cooling of hot bulk material, such as for example cement clinker, the bulk material is fed on a cooler grate through which cooling air flows. During transport from the start of the cooler to the, end of the cooler, cooling air flows through the bulk material thereby cooling it.

Various possibilities are known for the transport of the bulk material. In the so-called reciprocating grate cooler the bulk material is transported by movable rows of cooler grates which alternate with stationary rows of cooler grates in the direction of transport.

It is also known to provide a stationary aerating base, through which cooling gas can flow, in order to receive the bulk material, with conveyor elements for transport of the bulk material above the aerating base. In the transport mechanism there is a distinction between rotating conveyor elements and reciprocating conveyor elements.

A cooler according to the preamble to claim 1 is known from DE 878 625. The conveyor elements described there are formed by bars which are disposed above a stationary grate and extend in the longitudinal direction parallel to the plane of the grate. The bars are connected to a suitable moving mechanism which makes possible a reciprocating movement of the bulk material in the transport direction. In addition, suitable projections are provided on the bars in order to assist the conveying action.

In contrast to the rotating conveyor elements, in the case of the reciprocating conveyor elements the problem arises that some of the bulk material is carried back with the return stroke. However, this disadvantage can be compensated for by a suitable design of the conveyor elements. Thus for example conveyor-elements are proposed with a substantially triangular cross-sectional shape, in which the end face pointing in the transport direction is substantially perpendicular to the transport direction and the rear end face encloses an angle between 20 and 45° with the aerating base. Whereas in the forward stroke the substantially perpendicular end face achieves a good conveying action, in the return stroke the conveyor element can be drawn back under the bulk material due to its wedge shape.

Also with such a construction of the conveyor elements some of the quantity of bulk material is carried along with the return stroke.

The object of the invention, therefore, is to improve the cooler according to the preamble to claim 1 or the method according to the generic concept of claim 9 with regard to the conveying action.

This object is achieved according to the invention by the features of claims 1 and 9.

Further embodiments of the invention are the subject matter of the subordinate claims.

The cooler according to the invention for cooling hot bulk material has a stationary aerating base, through which cooling gas can flow, in order to receive the bulk material and also has reciprocating conveyor elements disposed above the aerating base for transport of the bulk material. The conveyor elements are provided in at least two groups which can be actuated jointly in the transport direction of the bulk material and separately from one another against the transport direction.

Particularly in the case of coarse bulk material, the bulk material forms a relatively compact unit which can be moved with the joint forward stroke of the conveyor elements in the transport direction. As the various groups of conveyor elements are actuated individually and successively with the return stroke, because of the friction conditions in the material bed considerably less bulk material is carried along against the transport direction than in the case of a joint return of all conveyor elements.

Each group of conveyor elements consists of at least one conveyor element or conveyor element line.

In a further embodiment of the invention it is also conceivable that the conveyor elements of a group can be actuated individually, so that they can be actuated for example at different speeds and for different lengths of time or with different strokes.

In a first embodiment the individual groups of conveyor elements are provided so that they alternate transversely with respect to the transport direction of the bulk material. In the tests on which the invention is based it has been shown that the best results can be achieved with three groups of conveyor elements which are disposed so that they alternate transversely with respect to the transport direction.

In a second embodiment the conveyor elements which are adjacent transversely with respect to the transport direction are disposed in such a way that at each phase of the sequence of movements they are oriented offset from one another in the transport direction.

In a third embodiment according to the invention the individual groups of conveyor elements are disposed so that they alternate in the transport direction of the bulk material.

Because of the friction conditions in the region of the lateral limits of the cooler or for reasons related to process engineering it may be advantageous to design the stroke of the conveyor elements to be of differing length over the width of the aerating base.

Further advantages and embodiments of the invention are explained in greater detail with reference to the description of some embodiments and the drawings.

Figure 2:
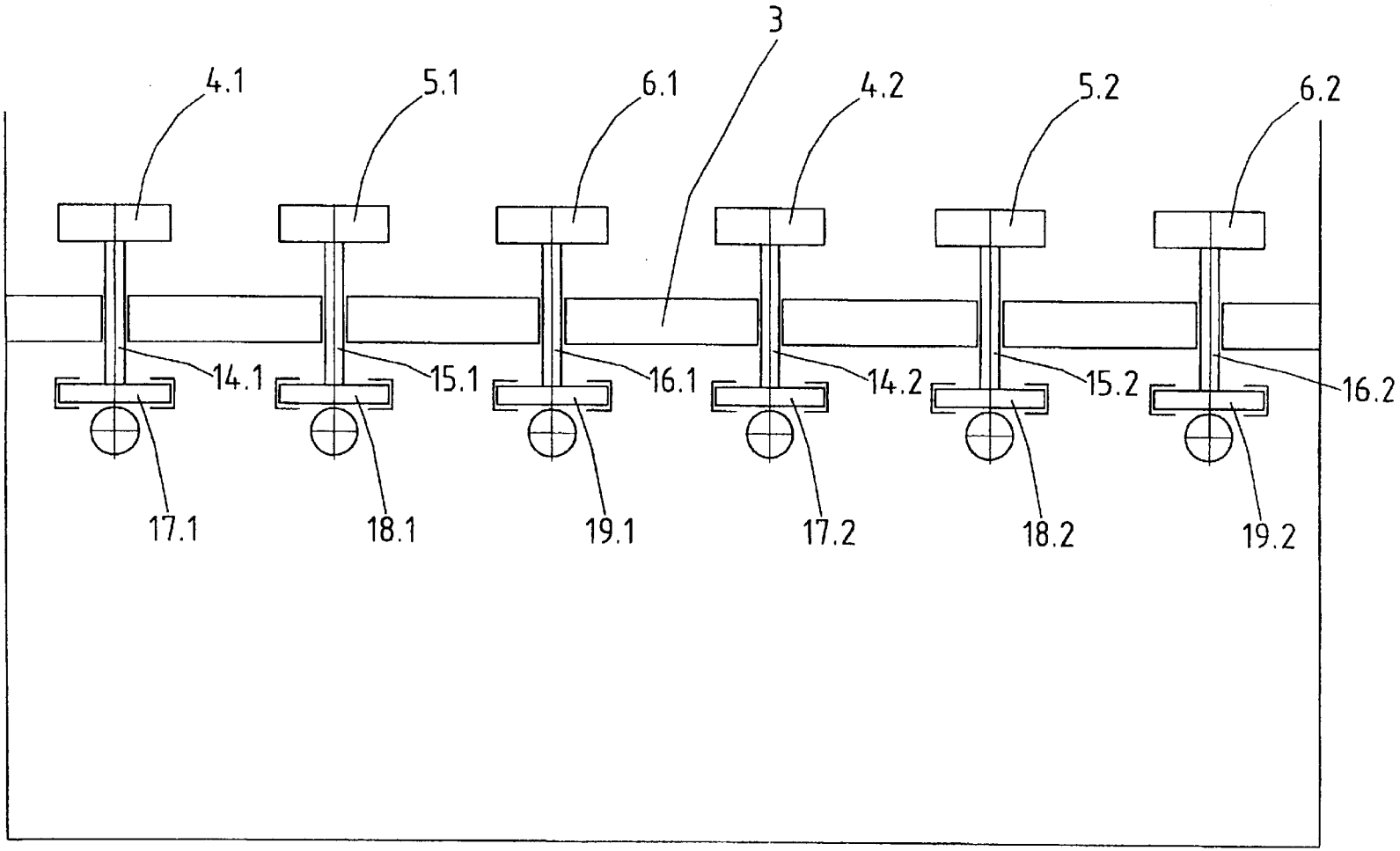
Figure 3D:
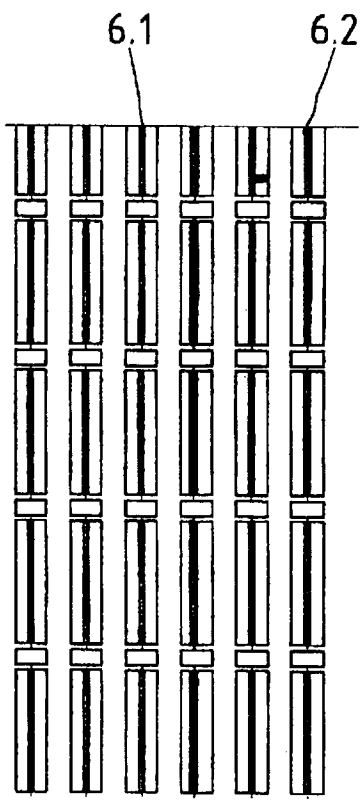
Figure 3C:
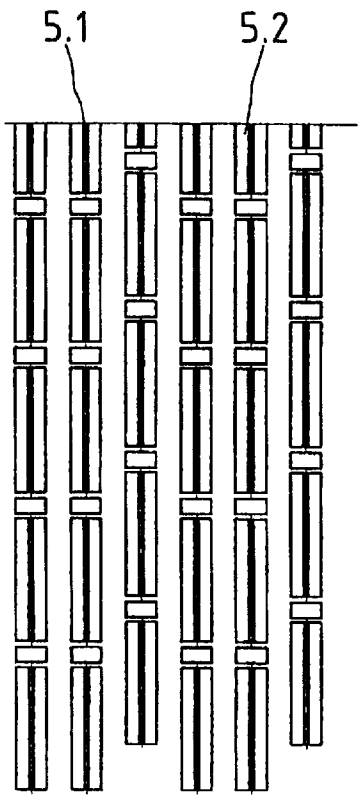
Figure 3B:
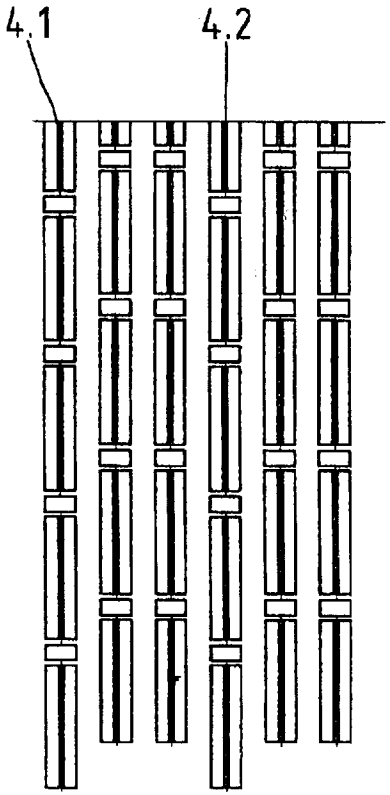
Figure 3A:
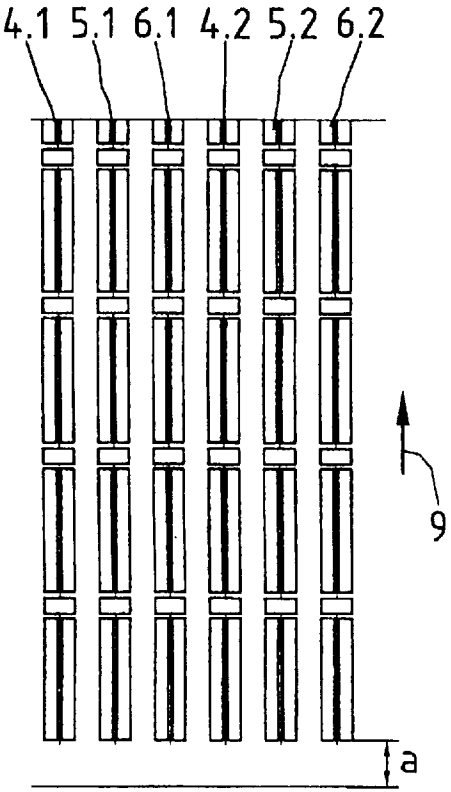
Figure 4:
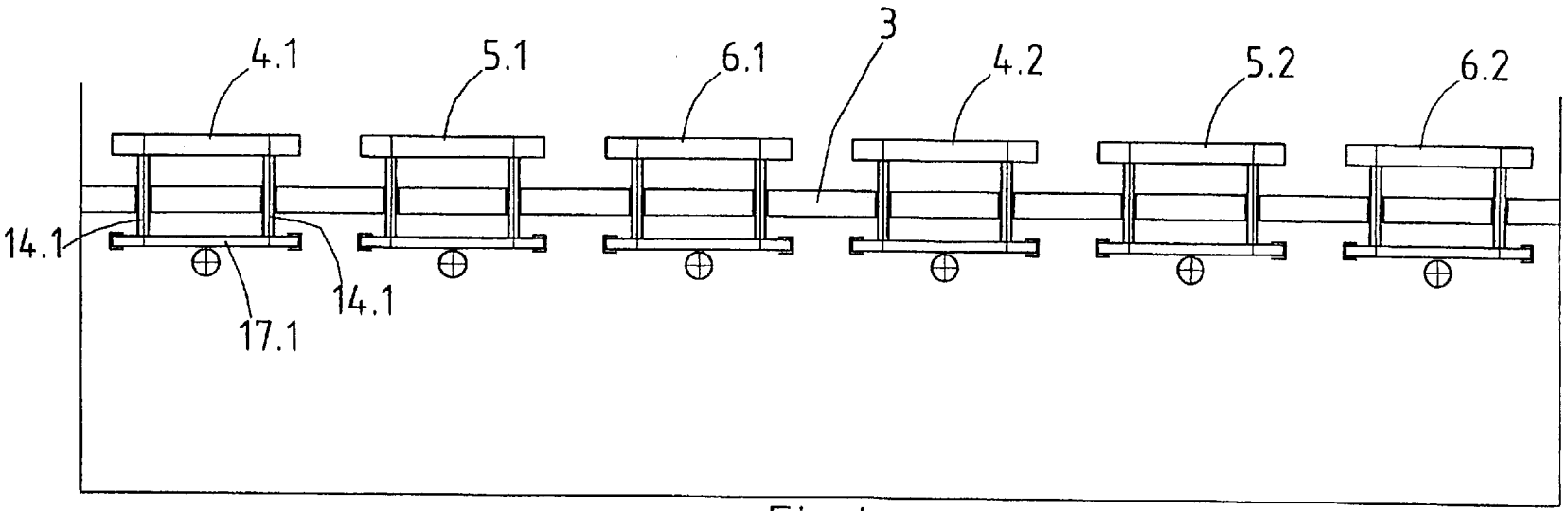
Figure 5D:
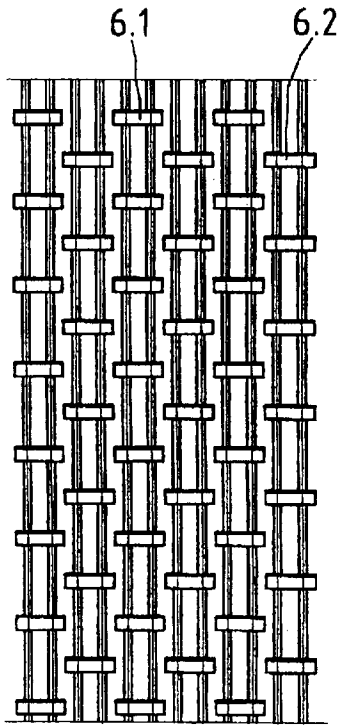
Figure 5C:
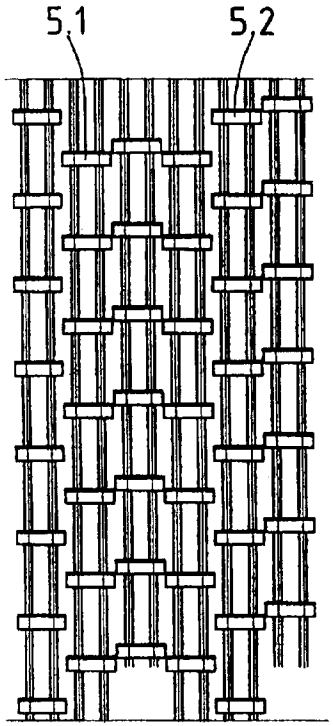
Figure 5B:
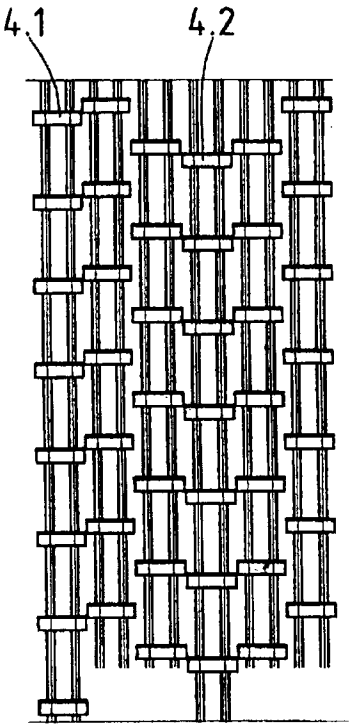
Figure 5A:
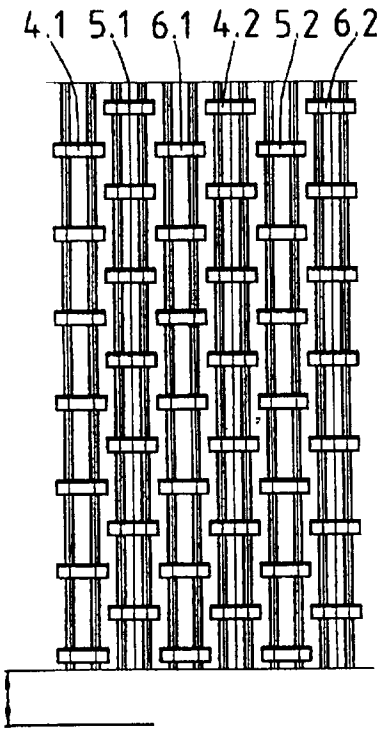
Figure 6:
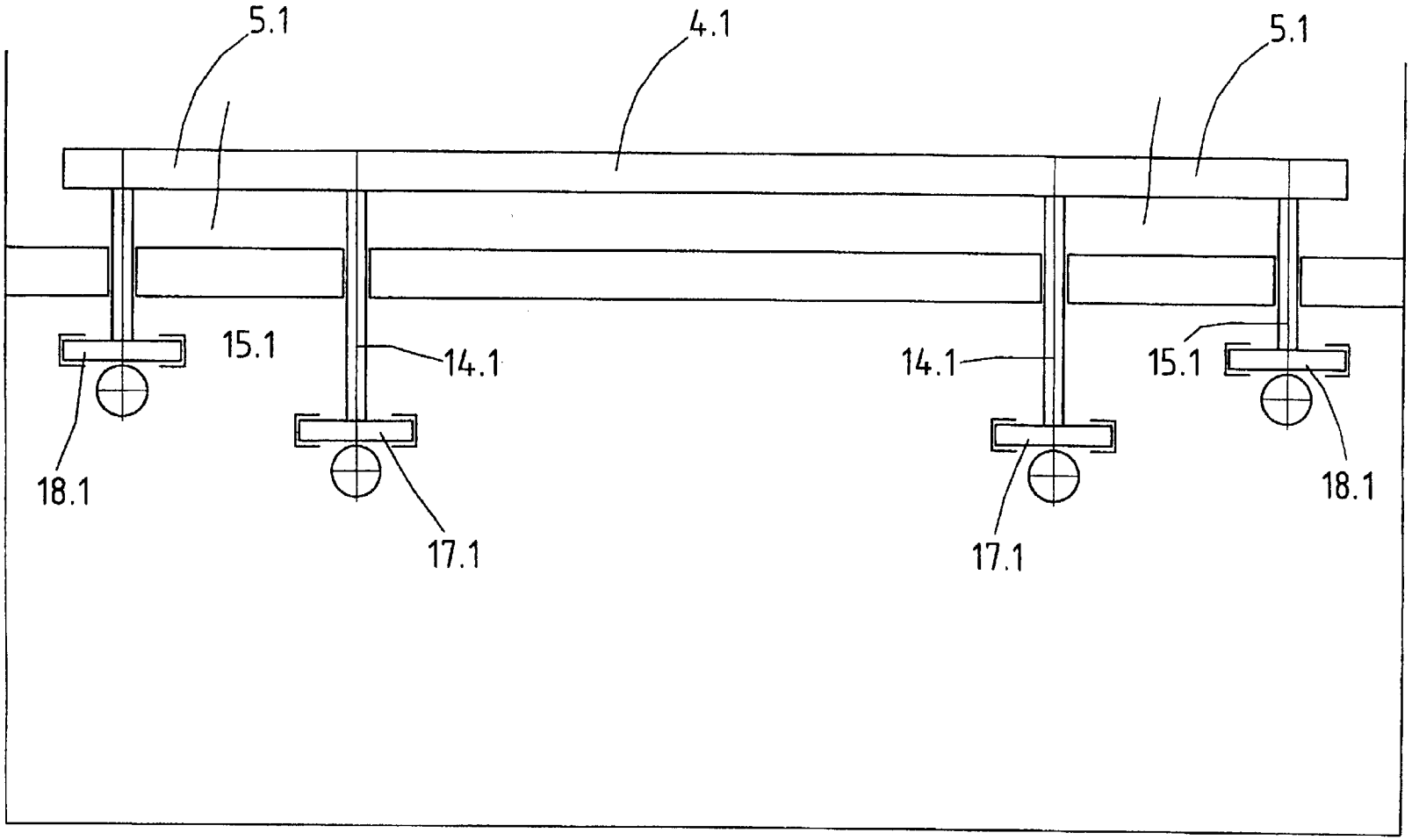
Figures 7A, 7B, 7C:
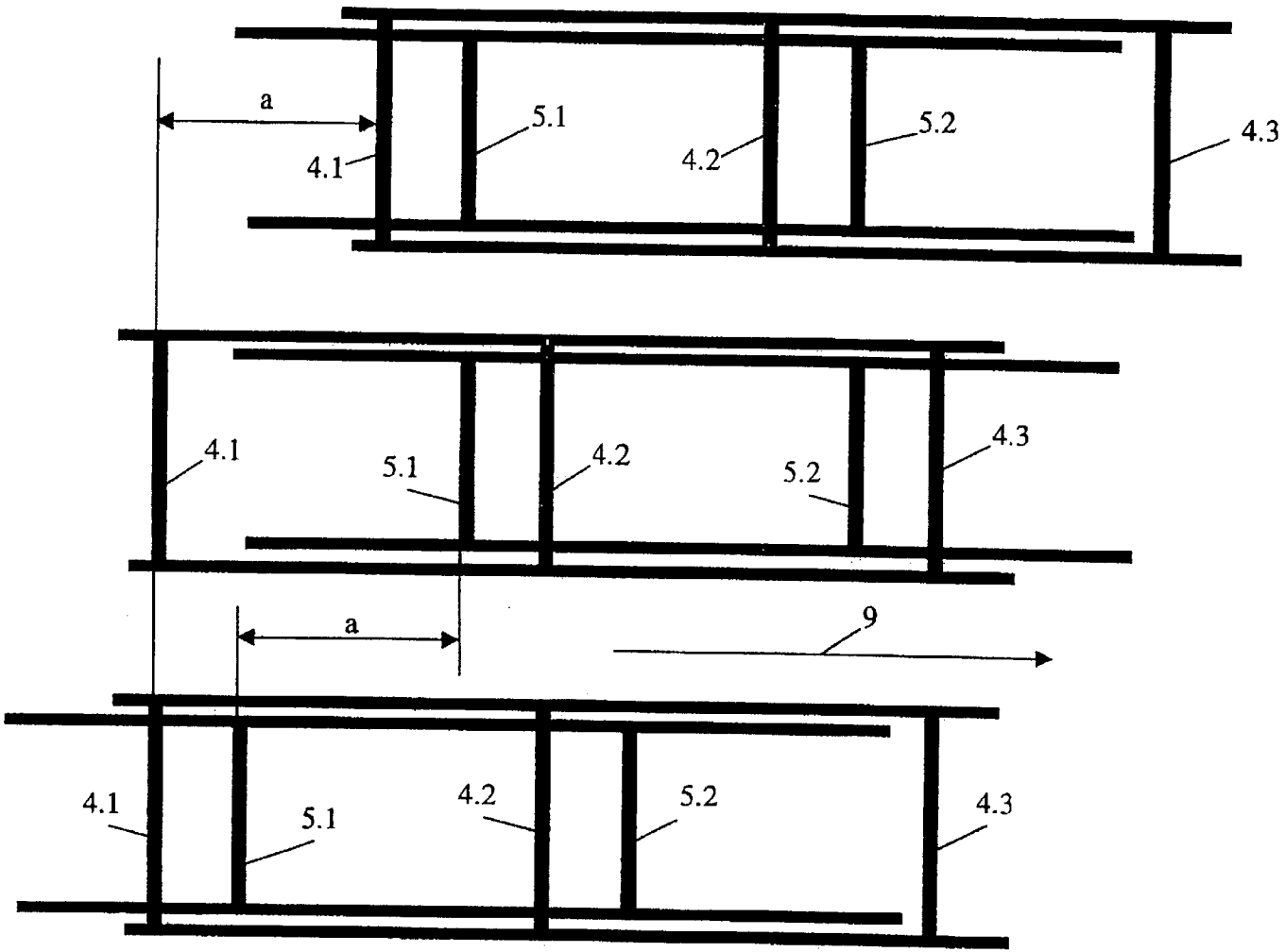

In the drawings:

FIG. 1 shows a schematic longitudinal sectional representation of the cooler, FIG. 2 shows a schematic cross-sectional representation according to a first embodiment of the conveyor elements, FIGS. 3*a* to 3*d* show a schematic representation of the sequence of movements in plan view of the first embodiment, FIG. 4 shows a schematic cross-sectional representation according to a second embodiment of the conveyor elements, FIGS. 5*a* to 5*d* show a schematic representation of the sequence of movements in plan view of the second embodiment, FIG. 6 shows a schematic cross-sectional representation according to a third embodiment of the conveyor elements, and FIGS. 7*a* to 7*c* show a schematic representation of the sequence of movements in plan view of the third embodiment.

The cooler 1 shown in FIG. 1 for cooling of hot bulk material 2 essentially comprises a stationary aerating base 3, through which cooling gas can flow, to receive the bulk material and also reciprocating conveyor elements 4, 5, 6 above the aerating base for transport of the bulk material. The bulk material 2 is formed for example by cement clinker which is delivered from a rotary kiln 7 connected upstream of the cooler. The bulk material proceeds via an oblique inlet region 8 onto the stationary aerating base 3 where it is transported through the cooler in the longitudinal direction by means of the conveyor elements 4, 5, 6.

The aerating base is constructed in a manner which is known per se and in particular has openings through which the cooling gas flows transversely through the bulk material bed, thereby cooling it. The cooling air openings in the aerating base 3 are designed so that a sufficient quantity of cooling air can be delivered but material is prevented from falling through the grate. In this case the cooling air is advantageously delivered below the aerating base 3. However, in the illustrated embodiments the air supplies are not shown in greater detail for reasons of clarity.

The conveyor elements are divided into at least two groups, whereby the at least two groups of conveyor elements can be actuated jointly in the transport direction of the bulk material and separately from one another against the transport direction. The detailed design and the sequence of movements of the conveyor elements in a first embodiment are explained in greater detail below with reference to FIGS. 2 and 3.

In this first embodiment three groups of conveyor elements 4, 5, 6 are provided which are disposed so that they alternate transversely with respect to the transport direction of the bulk material (arrow 9 in FIG. 1). In the illustrated embodiment six conveyor elements are provided over the width of the cooler 1, the conveyor elements 4.1 and 4.2 belonging to the first group, the conveyor elements 5.1 and 5.2 belonging to the second group and the conveyor elements 6.1 and 6.2 belonging to the third group. Of course, within the scope of the invention more or fewer conveyor elements can be disposed over the width of the cooler.

Each conveyor element 4.1 to 6.2 is connected via a support element 14.1 to 16.2 to suitable transport mechanisms 17.1 to 19.1. In the illustrated embodiment slots through which the support elements 14.1 to 16.2 are passed are provided in the aerating base 3.

The transport mechanisms which are associated with a specific group of conveyor elements can be coupled to one another for joint displacement of the conveyor elements. The reciprocating movement of the conveyor elements is achieved for example by way of a hydraulic drive.

The sequence of movements of the first embodiment is explained in greater detail below with the aid of FIGS. 3*a* to 3*d*. FIG. 3*a* shows the condition after the joint forward stroke of all conveyor elements 4.1 to 6.2. In this case all conveyor elements have been moved by a length a in the transport direction of the bulk material (arrow 9). The bulk material lying on the aerating base and thus also lying over the conveyor elements is displaced in a corresponding manner.

The conveyor elements are only moved back in groups or individually, so that as little bulk material as possible is transported back again with the return stroke of the conveyor elements. FIG. 3*b* shows the state after the return stroke of the conveyor elements 4.1 and 4.2, FIG. 3*c* shows the state after the further return stroke of the conveyor elements 5.1 and 5.2, whilst in FIG. 3*d* finally the last group with the conveyor elements 6.1 and 6.2 has also been moved back.

As can be seen in particular from FIGS. 1 and 3, a plurality of conveyor elements are also disposed in the transport direction over the length of the cooler. The cooler elements according to the first embodiment (FIGS. 2 and 3) extent substantially in the longitudinal direction, i.e. in the transport direction of the bulk material (arrow 9).

In the second embodiment according to FIGS. 4 and 5, a plurality of groups of conveyor elements 4.1 to 6.2 are again provided transversely with respect to the transport direction of the bulk material. The conveyor elements differ from the first embodiment essentially in that they extend substantially transversely with respect to the transport direction and accordingly are also supported in each case by way of two support elements (for example 14.1) and are connected or can be connected to a transport mechanism (for example 17.1).

Although the conveyor elements according to the second embodiment can be aligned transversely with respect to the transport direction in the initial position, as is the case in the first embodiment, in the second embodiment adjacent conveyor elements are disposed in such a way that after each phase of movement, i.e. after the joint forward stroke and after each individual return stroke they are oriented offset from one another in the transport direction.

The arrangement of the conveyor elements after each phase of movement is illustrated in FIGS. 5*a* to 5*d*. FIG. 5*a* shows the state after the joint forward stroke of all conveyor elements with a stroke length a. In this case it may be seen that adjacent conveyor elements (transversely with respect to the transport direction 9) are oriented offset from one another in the transport direction. After the first return stroke of the conveyor elements 4.1 and 4.2 of the first group an offset arrangement of adjacent conveyor elements is also produced. In FIG. 5*c* the conveyor elements 5.1 and 5.2 of the second group have also been drawn back and in FIG. 5*d* the conveyor elements 6.1 and 6.2 of the third group have been drawn back.

With the second embodiment the unwanted return transport of the bulk material with the return stroke of the conveyor elements can be reduced even better.

In FIGS. 6 and 7 a third embodiment is shown which essentially differs from the preceding embodiments by the fact that only two groups of conveyor elements are provided, and these are moreover provided so that they alternate in the transport direction 9 of the bulk material.

In the representation according to FIG. 6 the front conveyor element 4.1 is broken away at its two end regions in order to make visible the conveyor element 5.1 which lies behind it. Only three conveyor elements 4.1, 4.2 and 4.3 and only two conveyor elements 5.1 and 5.2 of the second group are shown for clarification in FIGS. 7*a* to 7*d*.

Each conveyor elements (for example 4.1) is connected via two supports elements (14.1) to a transport mechanism (17.1). In the illustrated embodiment all conveyor elements of a group are advantageously moved by way of a common transport frame.

As can be seen from FIG. 7*a*, the forward stroke is again carried out for both groups of conveyor elements jointly with a stroke length a. The state after the return stroke of the conveyor elements 4.1, 4.2 and 4.3 of the first group is shown in FIG. 7*b*. After the return of the conveyor elements 5.1 and 5.2 of the second group the initial state according to FIG. 7*c* is again achieved.

Within the scope of the invention it would also be conceivable for the stroke of the conveyor elements disposed transversely with respect to the transport direction to be set at different lengths in the first and second embodiment. As a result the differences in the material bed which are produced over the width of the aerating base can be compensated for. Thus for example the friction conditions within the bulk material in the middle of the cooler are different from those at the two edge regions. Also a different stroke length could be utilised for better transverse distribution of the material in the starting region of the cooler.

The stroke length of the conveyor elements should be designed to be adjustable for better adaptation of the stroke length to the requirements of the particular cooler.

In all embodiments the speed for the joint forward stroke can be chosen to be lower than for the return movements of the individual groups.

The aerating base preferably extends horizontally, but it would also be conceivable for it to be inclined downwards.

The material of the conveyor elements must be selected according to the temperature occurring and the wear to be expected. Welded and cast constructions for example may be considered for this. Moreover, suitable seals should be provided in the region of the through passages for the support elements in order to prevent material from falling through the grate.

The embodiments described above are distinguished in particular by the fact that the bulk material is not significantly carried along with the return stroke of the various groups of conveyor elements. Accordingly a smaller number of strokes is necessary for the movement of the bulk material, so that in particular the wear on the conveyor elements or the transport mechanism can also be reduced.

What is claimed is:

1. A cooler for cooling hot bulk material, comprising:

a stationary aerating base, through which cooling gas can flow, in order to receive the bulk material; and reciprocating conveyor elements disposed above the aerating base for transport of the bulk material, said reciprocating conveyor elements are classified into at least two groups of conveyor elements;

wherein said at least two groups of conveyor elements are actuated jointly in a transport direction of the bulk material and separately from one another against the transport direction.

2. A cooler as claimed in claim 1, wherein individual groups of conveyor elements are disposed so that they alternate in the transport direction of the bulk material.

3. A cooler as claimed in claim 1, wherein individual groups of conveyor elements are disposed so that they alternate transversely with respect to the transport direction of the bulk material.

4. A cooler as claimed in claim 1, wherein three groups of conveyor elements are provided which are disposed so that they alternate transversely with respect to the transport direction of the bulk material.

5. A cooler as claimed in claim 1, wherein each of three groups of conveyor elements is provided a number of times transversely with respect to the transport direction.

6. A cooler as claimed in claim 1, wherein the conveyor elements which are adjacent transversely with respect to the transport direction are disposed in such a way that, after each phase of actuation, they are oriented offset from one another in the transport direction.

7. A cooler as claimed in claim 1, wherein individual groups of conveyor elements are disposed so that they alternate transversely with respect to the transport direction of the bulk material, a stroke of the conveyor elements being of differing length over a width of the aerating base.

8. A cooler as claimed in claim 1, wherein the conveyor elements of a group can be actuated individually.

9. A method of cooling hot bulk material, comprising the following steps of:

feeding the hot bulk material on a stationary aerating base through which cooling gas can flow; and transporting the hot bulk material by means of reciprocating conveyor elements disposed above the aerating base;

wherein said conveyor elements are classified into at least two groups which can be actuated jointly in a transport direction of the bulk material and separately from one another against the transport direction.

10. A method as claimed in claim 9, wherein after the joint actuation of all groups of conveyor elements in the transport direction, in each case only one group of conveyor elements is actuated against the transport direction until all groups of conveyor elements have been set back again.

* * * * *